US006106276A

United States Patent [19]

Sams et al.

[11] Patent Number: 6,106,276

[45] **Date of Patent: *Aug. 22, 2000**

[54] GAS BURNER SYSTEM PROVIDING REDUCED NOISE LEVELS

[75] Inventors: Gary W. Sams; Merle B. Inman, both of Tulsa, Okla.

[73] Assignee: National Tank Company, Houston, Tex.

[ * ] Notice: This patent issued on a continued prosecution application filed under 37 CFR 1.53(d), and is subject to the twenty year patent term provisions of 35 U.S.C. 154(a)(2).

[21] Appl. No.: 08/877,394

[22] Filed: Jun. 17, 1997

Related U.S. Application Data

[60] Provisional application No. 60/025,709, Sep. 10, 1996.

[51] Int. Cl.[7] ..... F23D 14/70; F23D 14/82

[52] U.S. Cl. ..... 431/114; 431/346; 431/350; 431/354; 126/391; 126/350 R; 126/110 C; 126/99 C

[58] Field of Search ..... 431/114, 158, 431/346, 350, 354; 126/350 R, 390, 391, 392, 350 D, 110 C, 99 C, 21 A

[56] References Cited

U.S. PATENT DOCUMENTS

| | | | |
|---|---|---|---|
| 3,213,921 | 10/1965 | Walker et al. | 431/22 |
| 3,642,061 | 2/1972 | Waeselynck | 126/110 C X |
| 3,684,424 | 8/1972 | Zink et al. | 431/114 |
| 4,613,303 | 9/1986 | Willis et al. | 431/346 |
| 5,022,379 | 6/1991 | Wilson, Jr. | 126/116 R |
| 5,344,308 | 9/1994 | Cummings, III | 431/114 |
| 5,441,405 | 8/1995 | Bedford et al. | 431/286 |
| 5,580,238 | 12/1996 | Charles, Sr. et al. | 431/114 |

*Primary Examiner*—Ira S. Lazarus
*Assistant Examiner*—Josiah C. Cocks
*Attorney, Agent, or Firm*—Head, Johnson & Kachigian

[57] ABSTRACT

A gas burner is provided for use on the inlet end of a fire tube, and includes a mixer having attached to it a gas delivery pipe, fuel gas and air being combined in the mixer to provide mixed gas and air. A venturi is secured at its inlet end to the mixer to receive the flow of gas and air, the venturi serving to draw air into the mixer. A burner nozzle is affixed to the venturi outlet end and the burner nozzle and extends within the fire tube. A perforated tube surrounds the mixer/venturi and at least a portion of the burner nozzle. A sound absorbing flame cell housing surrounds the perforated tube. A flame arrestor closes an air inlet opening in the flame cell housing air and serves to permit air to pass into the flame cell housing but prohibits the passage of flame therethrough so that flame is confined within the interior of the flame cell housing. A sound absorbing flame arrestor cover is supported exteriorly of the flame cell housing and adjacent the flame arrestor and configured to permit free passage of air into the flame cell housing through the flame arrestor but prohibiting straight line passage of sound through the flame arrestor from the interior to the exterior of the flame cell housing.

19 Claims, 5 Drawing Sheets

27
12
26
16
62
90
56
76A
54D
22
24
93
4
4
76B
54A
54B
42
46
36
20
28
38
92
56
90
44
40

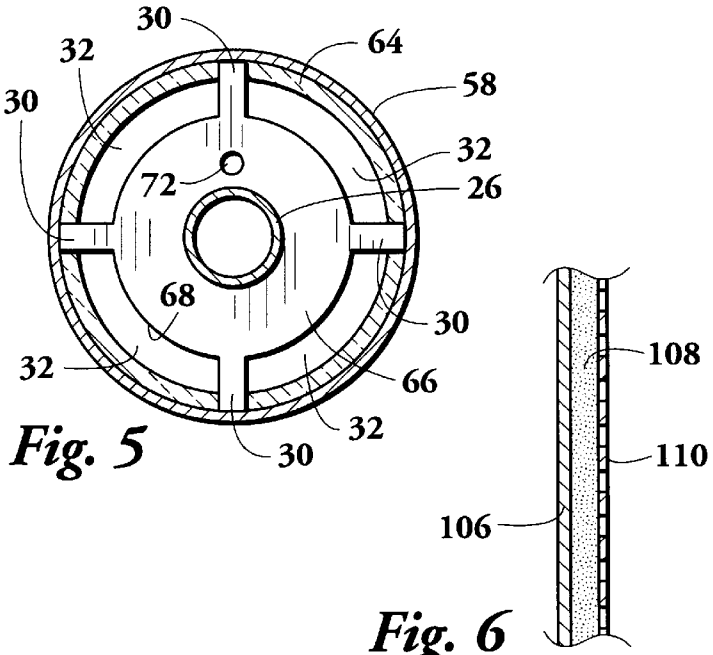
Fig. 5
Fig. 6
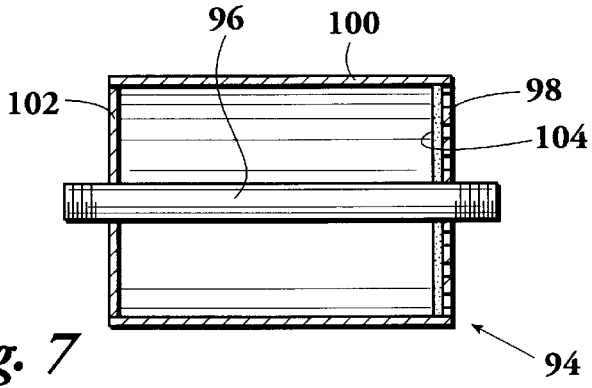
Fig. 7
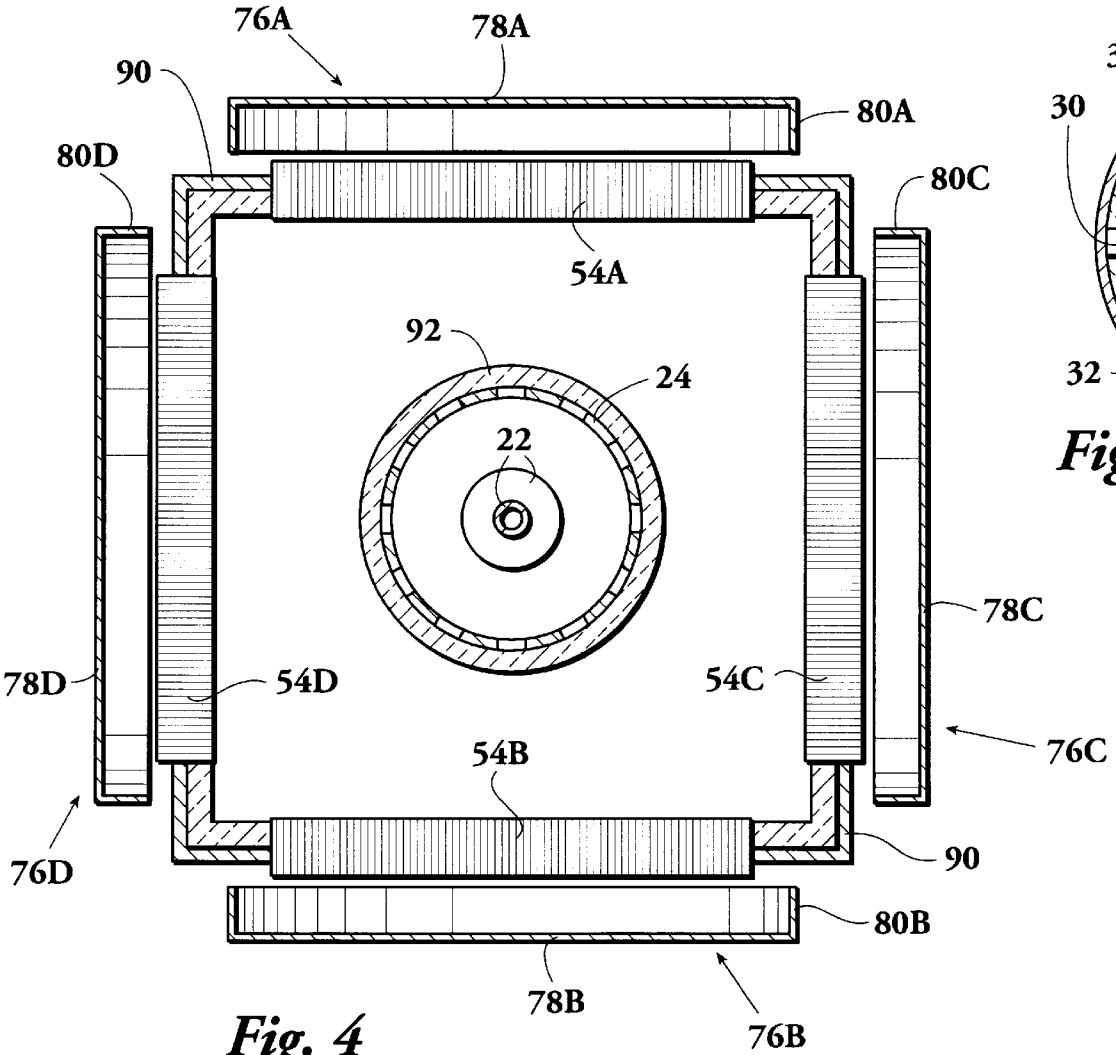
Fig. 4

GAS BURNER SYSTEM PROVIDING REDUCED NOISE LEVELS

REFERENCE TO PENDING APPLICATIONS

This application is based on Provisional Application 60/025,709 filed Sep. 10, 1996.

REFERENCE TO MICROFICHE APPENDIX

This application is not referenced in any microfiche appendix.

BACKGROUND OF THE INVENTION

A common means of producing heat, especially large quantities of heat, such as required in furnaces, boilers, process equipment and so forth, is derived from combusting gas in air. Natural gas provides a highly desirable fuel for generation of heat for process applications since it is readily available and is not environmentally harmful, that is, the combustion of gas and air under ideal conditions provides relatively few harmful bi-products of combustion.

One problem that exists with gas burners of the type required to produce large quantities of heat is that such burners frequently produce substantial noise.

A common type of heating system utilizing gas includes the arrangement wherein a gas and air mixture is injected into a fire tube. A fire tube is typically a relatively long tubular member having air and gas injected at one end, the opposite end being connected to a stack for venting the products of combustion. The fire tube can be positioned in process equipment, such as an indirect heater in which the fire tube is placed in a water bath, a steam bath, on in a salt bath heater in which the products of combustion act as a heat transfer medium. A fire tube is one example of a type of enclosure in which burners are employed and with which the present invention is concerned.

In recent years increased attention has been given to reducing the noise from gas fired heaters. Many utilities, as well as distribution and transportation companies, and other industries in which heat is employed, such as the oil and gas industry, have experimented with ways of reducing the sound intensity of a gas fired heater. In densely populated areas of the United States, such as in the northeastern states, the effort to reduce the noise produced by gas fired heaters has attracted substantial attention. Some states have prescribed noise limits to be met by the users of gas fired burners. An example of the noise limitations that have been adopted include the restriction that the noise at the property line of a property on which a gas fired heater is employed cannot exceed 50 dbA. When it is realized that gas fired heaters are capable of producing sound intensities in excess of 100 dbA it can be understood that this sound limitation becomes a serious problem. As an example, in order to meet the 50 dbA at the property line, a heater located at a distance at 48 feet from the property line cannot produce a sound level exceeding 73 dbA measured at a distance of 3 feet from the heater. Reducing the sound that is generated by a typical gas fired heater that is, about 100 dbA, to 73 dbA has been a daunting task.

In order to reduce the sound intensities the type and arrangement of burners employed have been changed but substantial reduction in noise intensity has not been overly successful. It has been learned that there are basically three sources of noise originating from a gas fired heater. These are: (1) combustion process noise; (2) resonance or beat noise generated between the hot portion and cold portions of a gas fired heater, particularly of the type heater that uses a fire tube connected to an exhaust stack; and (3) secondary noise emitted from the heater shell, flame arrestor stack and other components connected directly to the heater. These sound sources fall across several octaves of the sound spectrum. The noise associated with the combustion process generally ranges from 400 Hz to 1000 Hz. The noise associated with the resonance of a fire tube type gas heater falls generally between 5 Hz and 30 Hz. The secondary noise source varies most widely and in a range approximately between 10 Hz and 300 Hz.

Techniques commonly employed to reduce the noise of gas burners, particularly of the type that use a flame arrestor, include the use of larger fire tube diameters and lower burner pressures. While these techniques result in reducing sound intensities, such sound reductions are achieved at the penalty of increased equipment costs. That is, a larger fire tube diameter is obviously much more expensive than a fire tube of a smaller diameter and, in addition, low pressure burners limit heater throttling to a narrow range sacrificing capacity and flexibility.

Others, in an attempt to reduce sound levels, have provided housings for burner assemblies or have used forced draft burners to allow higher pressure drops to be taken through silencers. Obviously, either of these efforts incur substantial increased costs.

A general object of the present invention is to provide a burner system that employs flame arrestors and critical placement of sound absorbing baffles and liners, to achieve reduction in sound levels without resorting to larger fire tube diameters, or resort to lower pressure burners and without the necessity, in most cases, of resorting to the use of housings or forced draft burners to overcome pressure drops associated with the use of silencers.

A better understanding of the invention will be obtained from the following description of the preferred embodiments, taken in conjunction with the attached drawings.

SUMMARY OF THE INVENTION

This invention provides a gas burner system that produces noise levels substantially below those of gas burners in present use. While not so limited, the gas burner disclosed herein is particularly useful to provide heat for use in process systems that employ a burner tube. Such systems are represented by heater/treaters used in the oil industry wherein produced crude oil is heated to augment the separation of water in which the heater/treater typically includes a relatively large vessel having a fire tube passing through it, the inlet end of the fire tube serving to receive a flame therein and the outlet end being vented to the atmosphere.

The system of this invention employs a mixer to mix fuel gas and air herein. Accordingly, the mixer has a gas delivery pipe attached to it and inlet openings to receive inlet air flow. Conforming to standard burner designs there is attached to the mixer a venturi providing a reduced cross-sectional area flow path adjacent the mixer and expanding in flow path diameter in directions away from the mixer. The typical venturi is substantially frusto-conical in external configuration. The flow of gas through the venturi creates a reduced pressure area to pull air into the mixer.

Attached to the outlet end of the venturi is a burner nozzle. When the heating system is used in conjunction with a fire tube the burner nozzle typically extends for a short distance into the fire tube.

The mixer, venturi and a portion of the fire tube is surrounded by a perforated tube, that is, a cylindrical metal tube having perforations therein to provide for passage of air into the interior of the perforated tube and thereby into the interior of the mixer and the passage of air into the inlet end of the fire tube. A sound absorptive layer is preferably affixed to the perforated tube, the sound absorptive layer consisting of a porous material, such as fiberglass matting, that absorbs sound but through which air freely passes.

Surrounding the perforated tube is a flame cell housing which typically is made of metal and which also preferably has a sound absorptive layer material thereon. The flame cell housing has at least one opening therein that receives a flame arrestor. In one embodiment the flame cell housing is tubular with the flame arrestor closing one tubular end. In another embodiment the flame cell housing is square or rectangular, with at least one opening in one side wall of the housing. The flame arrestor functions to permit the free flow of air therethrough but prohibits the passage of flame from within the interior to the exterior of the flame cell housing. That is, the flame arrestor serves to confine the possibility of flame escaping the interior of the flame cell housing while permitting the free flow of air through it.

Each of the flame arrestors has a companion flame arrestor cover exteriorly of the flame cell housing. The flame arrestor cover is dimensioned and configured according to the shape of the flame arrestor to fully cover the flame arrestor in a way to prevent straight line passage of sound from within the flame cell housing to the exterior. Accordingly, in the embodiment wherein the flame cell housing is tubular the flame arrestor cover preferably has a planar circular portion with a circumferential, short length tubular flange portion, the planar circular portion and the flange portion being spaced away from the flame arrestor so as to provide for the flow of air past the flame arrestor cover and through the flame arrestor into the interior of the flame cell housing.

To confine sound generated within the burner tube, the flame cell housing has a baffle housing at the end thereof through which the burner nozzle extends. This is accomplished by providing an annular ring at the outer end of the perforated tube. Secured to the annular ring is the baffle housing that provides an increased internal diameter circumferential portion surrounding the burner nozzle. A radially extending baffle plate surrounds the burner nozzle and has an outer circumferential periphery that extends within the baffle housing so that the baffle plate intercepts sound that would tend to pass from within the burner tube and into the flame cell housing.

By this construction, the areas of the burner system that are the sources of most go of the sounds generated by the system are confined by the flame cell housing and in a way that permits the free flow of air into the burner system.

DESCRIPTION OF THE DRAWINGS

FIG. 4 is an elevational cross-sectional view taken along the line 4—4 of FIG. 3 showing the arrangement of the plurality of flame arrestors.

FIG. 5 is a cross-sectional view, in reduced scale, of the baffle housing and baffle as taken along the line 5—5 of FIG. 1.

FIG. 6 is a cross-sectional view of an example of a composite sound baffle of a type that may be employed in various places in the sound reduction burner system.

FIG. 7 is an elevational cross-sectional view of a resonator sound baffle that can be employed in conjunction with the system.

DETAILED DESCRIPTION OF THE PREFERRED EMBODIMENTS

Figure 1:
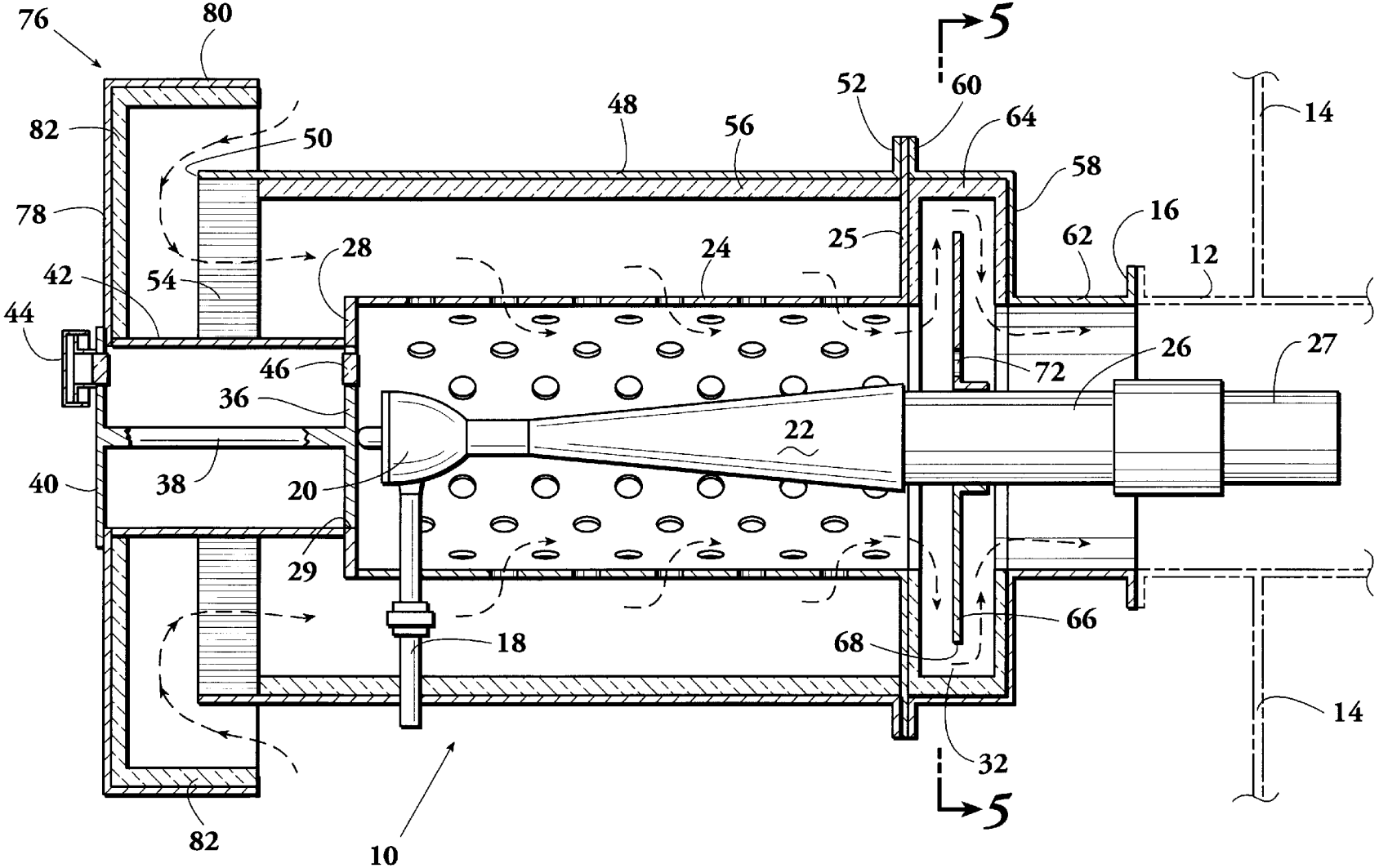
FIG. 1 is an elevational cross-sectional view of a gas burner system of this invention that has improved sound reduction characteristics.

Referring to the drawings and first to FIG. 1, a gas burner system having improved noise reduction that incorporates the principles of this invention is generally indicated by the numeral 10. The burner system is shown attached to a fire tube 12 that is shown in dotted outline, the fire tube extending inside an enclosure 14, also shown in dotted outline. Fire tube 12 and enclosure 14 are illustrative of the environment in which the invention is employed. The gas burner system of this disclosure is made up of the components that attach to the outer end of fire tube 12 such as by means of a flange 16, however, other arrangements may be employed for coupling the gas burner system to a fire tube. The outer end of fire tube 12 may be coincident with a wall of enclosure 14, or the gas burner system may be attached directly to an enclosure other than a fire tube.

Gas is supplied through a conduit 18 to a mixer head 20 which communicates with a cone shaped venturi 22. Mixer 20 and venturi 22 are positioned concentrically within a perforated tube 24. An outlet conduit 26 connects with venturi 22 and extending into fire tube 12 and communicate, by means of a coupling with a burner nozzle 27.

An end plate 28 is positioned at one end of perforated tube 24. An annular ring 25 is attached to the other end of perforated tube 24 to provide support for the perforated tube. A large diameter opening 29 is formed in end plate 28 and is normally closed by a door 36 that is supported on the outer end of a shaft 38 extending from a closure flange 40.

Extending rearwardly from end plate 28 is a tubular member 42 that provides access to the burner. When flange 40 is removed, shaft 38 and door 36 are simultaneously removed, providing access to mixer 20 from the exterior of the burner system to thereby enable a workman to adjust the mixer as required.

Supported in closure flange 40 is a sight glass 44. In alignment with sight glass 44 there is a small opening 46 (that may or may not have a sight glass) in door 36 providing a visual path by which a workman can observe a flame within fire tube 12.

Surrounding perforated tube 24 is a cylindrical flame cell housing 48 that is open at a first end 50 and has a flange 52 at its other end. Received within the open first end 50 is a cylindrical flame arrestor 54 that surrounds tubular member 42. Flame arrestor 54 provides a pathway for the passage of air into the interior of flame cell 48 but prohibits a flame from passing in the opposite direction, that is, flame arrestor 54 is formed of thin metal with small diameter air passageways, the thin metal serving to reduce the temperature of flame that would attempt to pass rearwardly from within the flame cell 48 to the exterior environment by reducing the temperature of the combustion mixture below the ignition temperature. The use of flame arrestors of the type employed in element 54 are well known in the industry and are readily commercially available.

Affixed to the interior surface of flame cell 48 is a layer of sound absorption material 56. The sound absorption material extends from flame arrestor 54 to flange 52 and may be of fibrous material, preferably non-combustible, such as compacted fiberglass or the like that absorbs and deadens sound that would otherwise pass through or reflect from the wall of flame cell 48.

Affixed to flange 52 is a cylindrical baffle housing 58 having, as a part thereof, a flange 60 that is secured by bolts (not shown) to flange 52. Baffle housing 58 is typically made of metal and has an integral tubular portion 62 connecting to flange 16 by which the burner system is attached to fire tube 12.

Received within the interior of baffle housing 58 is a layer of sound absorption material 64 which may be of the same type as element 56 employed within flame cell 48.

Outlet conduit 26 passes through a baffle plate 66. As seen in FIG. 5, baffle 66 has integral extending legs 30, the outer ends of which engage or are affixed to baffle housing 58 providing openings 32 therebetween through which air can be drawn into fire tube 12. The outer circumferential edge 68 of baffle 66 extends within the confines of baffle housing 58, baffle 66 serving to intercept sound waves that would tend to travel from fire tube 12 backwardly into the burner system. The dimensions of baffle housing 58 relative to baffle 66 are such as to provide an ample circumferential air passageway for the passage of combustion air from within perforated tube 24 to enter into fire tube 12.

A relatively small diameter opening 72 is provided in baffle 66 that is in alignment with sight glass 44 and opening 46 to provide a view from the exterior of the burner system to verify the existence of a flame within fire tube 12.

Surrounding tubular member 42, rearwardly of flame arrestor 54, is a flame arrestor cover generally indicated by the numeral 76. The diameter of cover 76 exceeds the diameter of flame arrestor 54. Cover 76 consists of a planar portion 78 and tubular portion 80. Sound absorbing material 82 covers the interior of both the planar and the tubular portions of the flame arrestor cover.

The gas burner system of FIG. 1 achieves substantial noise reduction compared to the known type of gas burners used for industrial applications. By providing sound insulated flame cell 48 that surrounds perforated tube 24 substantial reduction in the sound the emanates from the burner is obtained. Further, the utilization of baffle housing 58, having sound absorptive material therein, in combination with baffle 66 further substantially reduces the noise emanating from within fire tube 12. Finally, the employment of a flame arrestor cover 76 functions to intercept sound that passes out of the flame cell through flame arrestor 54.

Figure 1A:
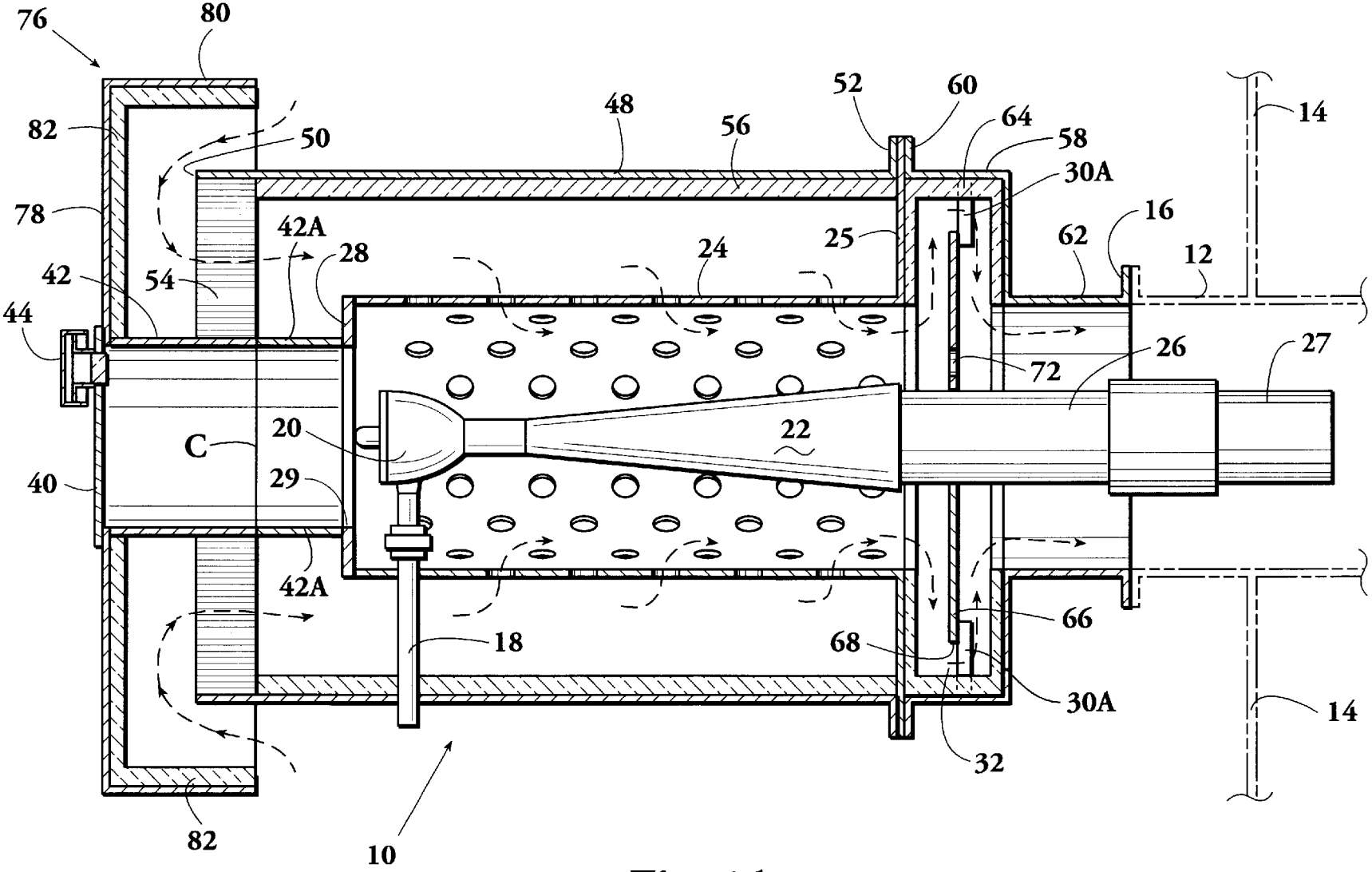
FIG. 1A is an elevational cross-sectional view of the gas burner system essentially as shown in FIG. 1 but showing modifications primarily intended to achieve economy in manufacturing the system.

In the system of FIG. 1A, tubular member 42 that supports flame arrestor 54 is formed into two parts, that is, an outer portion 42 and an inner portion 42A, the portions being of the same diameter and in axial alignment and separated from each other along a contact line C. Flame arrestor 54 can be economically constructed by winding a strip of foraminous material around tubular member 42 to achieve the desired external diameter to match the internal diameter of flame cell housing 48. Flame cell element 54 itself may be employed to support tubular member 42 and flame arrestor cover 76 attached to it or supplementary support (not shown) may be provided between the flame arrestor cover and flame arrestor housing 48.

Another change in FIG. 1A compared to FIG. 1 is the means of supporting baffle plate 66. Whereas in FIG. 5 baffle plate 66 has integrally formed legs 30 and includes an internal flange portion that fits around outlet conduit 26, in FIG. 1A the internal flange is eliminated and separate legs 30A are secured to baffle 66 and engage the internal surface of baffle housing 58. Legs 30A can be in the form of short lengths of metallic members welded to baffle plate 66.

Figure 2:
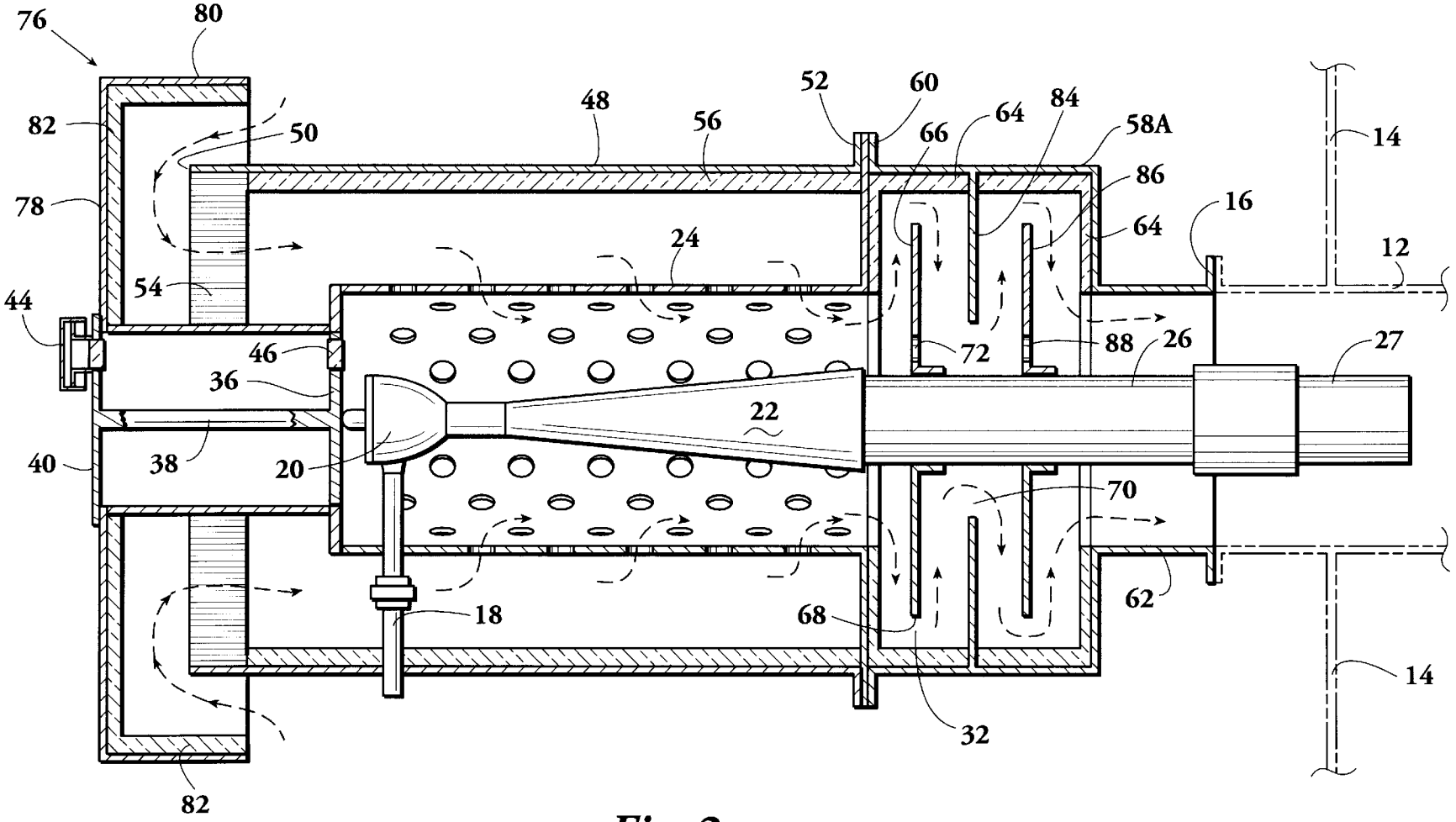
FIG. 2 is an elevational cross-sectional view of a gas burner employing the sound reduction features of the burner of FIG. 1 and showing an alternate embodiment in which a plurality of baffles are employed between the flame cell and the burner tube.

FIG. 2 illustrates an alternate embodiment of the invention of FIG. 1. FIG. 2 is different from FIG. 1 basically only in the arrangement of the baffle housing and baffles. The baffle housing 58A in the system of FIG. 2 is of increased length and includes an internal toroidal baffle 84, thereby dividing the interior of baffle housing 58A into two circumferential segments. In addition to a first baffle plate 66 as was described with reference to FIG. 1 and FIG. 5, the embodiment of FIG. 2 employs a second baffle plate 86, the baffle plates 66 and 86 being spaced to either side of toroidal baffle 84. The air passageway 70 provided in the embodiment of FIG. 2 results in more changes of direction of air and further restricts sound travel from fire tube 12 rearwardly do into flame cell 48. The system of FIG. 2 functions otherwise in the same way as that of FIG. 1. More than two baffles may be employed as needed for noise reduction.

Second baffle plate 86 has a small diameter opening 88 in alignment with opening 72 in first baffle 66 to permit a view of the flame within fire tube 12.

Figure 3:
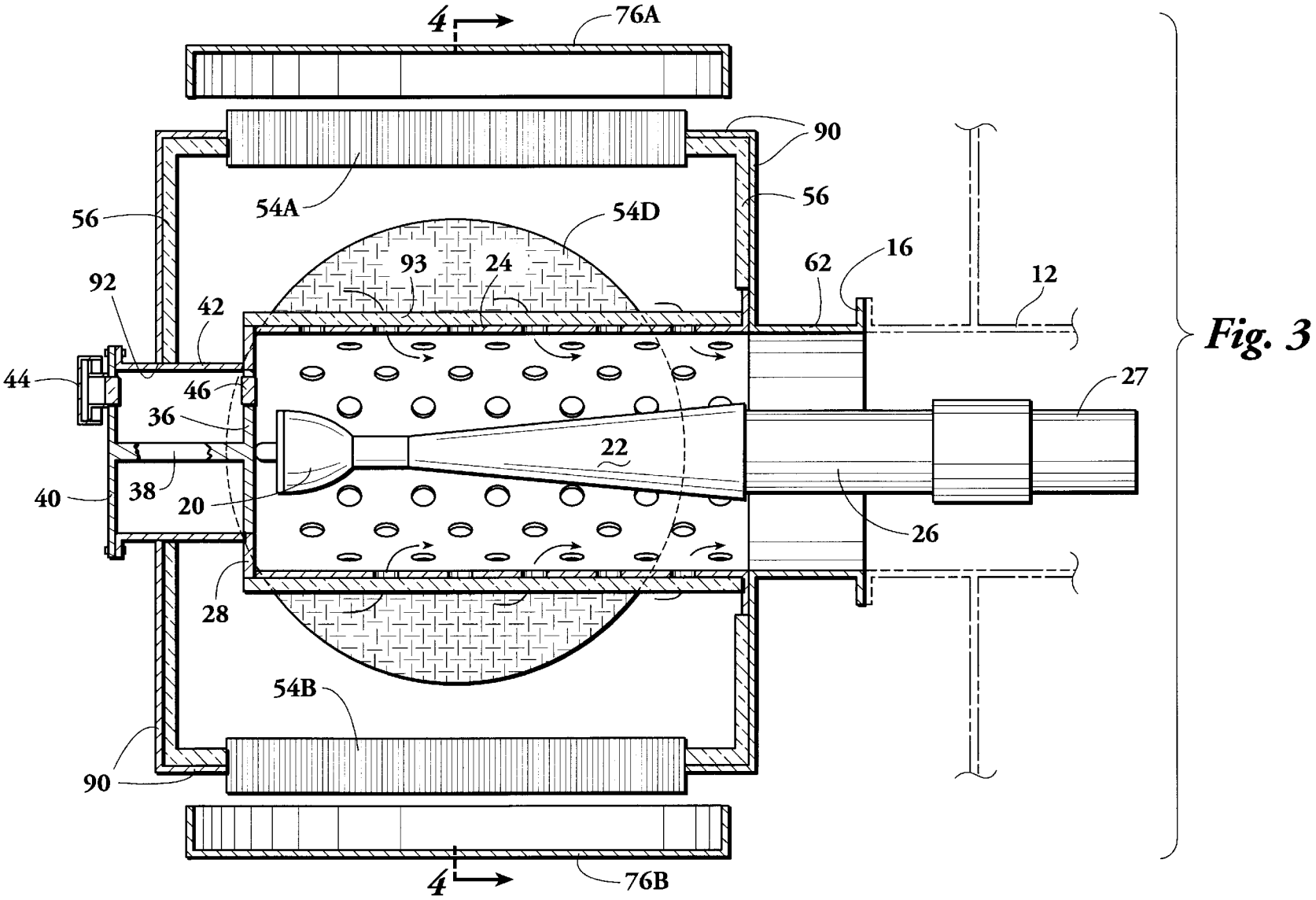
FIG. 3 shows a second alternate embodiment of the invention in elevational cross-sectional view. The system of FIG. 3 employs a plurality of spaced apart flame arrestors arranged circumferentially around the flame cell.

Turning now to FIGS. 3 and 4, another alternate embodiment of the invention is seen. The primary difference in the embodiment of FIGS. 3 and 4 compared to that of either FIG. 1 or FIG. 2 is the shape of the flame cell housing and the placement of flame arrestors. Further, rather than a cylindrical walled flame cell housing as in FIGS. 1 and 2, the flame cell housing 90 in FIGS. 3 and 4 is of square or rectangular shape. Flame cell housing 90, like flame cell housing 48, includes an outer structural metal housing having sound absorption material 56 formed on the interior surface.

The alternative embodiment of FIG. 3 may also employ the baffle arrangements shown in FIGS. 1, 1A and 2 between housing 90 and tubular element 62.

An opening 92 is formed in the end wall of flame cell housing 90 and receives tubular member 42 that communicates with and supports end plate 28 which, in turn, is attached to and supports perforated tube 24. A sound absorptive layer 93 surrounds perforated tube 24. Sound absorptive layer 93 can be a compacted layer of fiberglass which freely permits air to pass through but which intercepts and decreases sound emanating from within the burner.

The embodiment of FIGS. 3 and 4 is different from that of FIGS. 1 and 2 in the placement of the flame arrestors. While in FIGS. 1 and 2, a single flame arrestor is employed in axial alignment with the burner, in the embodiment of FIGS. 3 and 4, a plurality of flame arrestors may be employed. FIG. 4 indicates four separate flame arrestors 54A, 54B, 54C, and 54D. This is not to imply that in the typical application of the invention four flame arrestors will be employed at all times. The number of flame arrestors depends upon the size of the burner, the square footage area of the flame arrestors and other engineering factors. The number of flame arrestors may be from one to four and it is anticipated that only a small percent of applications of the invention will require four flame arrestors. The flame arrestors 54A through 54D function the same as flame arrestor 54 of the embodiment of FIGS. 1 and 2, that is, they allow air to pass freely therethrough but prevent a flame from passing from within flame cell housing 90 outwardly into the environment.

Each of flame arrestors 54A, 54B, 54C and 54D is provided with a flame arrestor cover 76A through 76D, each of which have a planar portion 78A through 78D and a tubular portion 80A through 80D. Each of covers 76A through 76D stand off from its associated flame arrestor to provide an air passageway between each flame arrestor cover and its associated flame arrestor so that air can freely pass into the interior of flame cell housing 90. Flame arrestor covers 76A through 76D may (and normally will) include sound absorptive material on the interior surface thereof, such as the sound absorptive material 82 secured to the interior of flame arrestor cover 76 as shown in FIGS. 1 and 2.

In FIG. 3 flame cell housing 90 is attached by flange 16 to a flange of fire tube 12 that extends through enclosure wall 14. FIG. 3 does not show the use of a baffle housing or baffle such as baffle housing 58 and baffle 66 as seen in FIG. 1, however, it is understood that a similar baffle housing and baffle may be employed in the same way with reference to the embodiment of FIG. 3. Further, a multiple baffle housing of the type identified by 58A in FIG. 2 with multiple baffles may be employed in the embodiment of FIG. 3.

FIG. 7 illustrates, in cross-sectional view, a Helmholtz tuned resonator chamber, generally indicated by the numeral 94, that may be substituted for conduit 26 and baffles 66, 84 and 86 to absorb low frequency noise from the combustion process. The air/gas mixture from venturi 22 passes through conduit 96 to burner nozzle 27. A perforated plate 98 covers one end of cylindrical chamber 100; the opposite end being covered by a solid plate 102. A sound absorptive material 104 is secured to the interior of perforated plate 98. Standing sound waves are generated within the resonant chamber to interfere with and block the passage of sound rearwardly through the chamber.

To attenuate lower frequency sounds emanating from the opposite or stack end of fire tube 12 (not seen in the drawings), a similar Helmholtz chamber may be installed at the fire tube discharge end.

The invention as herein described provide a combination of components selected and assembled to reflect, absorb, refract and phase shift sounds associated with a gas/air combustion process. The intent of the structures illustrated is to provide effective noise attenuation with a minimum combustion air pressure drop, thus permitting industries the luxury of using natural draft burners. The invention provides a tortuous path through the flame arrestor for the flow of combustion air while eliminating straight line movement of sound from within to the exterior of the burner. The design allows for the free flow of combustion air into the flame cell and the fire tube while creating several turns in the air flow path to reduce the propagation of combustion noise from passing out through the flame arrestor or arrestors.

Since any tortuous path of air flow through the burner will create some additional pressure drop, the flame arrestor cell area of designs that incorporate the principles of this invention must be increased to prevent the additional pressure drop from requiring additional stack heights (from which additional noise could be created). This can be achieved by enlarging the diameter of the single flame arrestor of FIGS. 1 or 2 or using multiple flame arrestors as provided in the embodiment of FIGS. 3 and 4.

The mixer assembly is housed in perforated tube 24 to provide sound isolation between the combustion process and the flame arrestor or flame arrestors. Tube 24 should be perforated with sufficient open area so that the pressure drop of combustion air entering the burner is minimal. Combustion air entering perforated tube 24 flows both into mixer 20 and directly into fire tube 12. The percentage of air entering mixer 20 can vary from 10% of the stoichiometric air required by the combustion process up to 100%. The air inspirited by the mixture is roughly controlled by the fuel gas pressure, air register setting, burner nozzle opening, and orifice size. The amount of air entering the mixer typically varies from 20% to 50% of the stoichiometric air required when the burner is used with a fire tube 12. This air is commonly referred to as primary or premixed air and is mixed with 100% of the fuel gas prior to emission at the burner nozzle 27. After entering the perforated tube, the remainder of the air that does not flow through mixer 20 is drawn toward the fire tube by a combination of the available stack draft and the inspiration generated by the flame velocity in the fire tube.

Remaining air flows around a baffle plate, or a series of baffle plates into fire tube 12. The baffle plates and chambers absorb and reflect sound back to the source while allowing air to flow into the fire tube without significant pressure drop. After flowing around the baffles the air enters the fire tube where it diffuses into the flame as required by the combustion process. This air volume, commonly referred to as secondary air, is dependent on the stack height and diameter (stack draft) and the fire tube and stack pressure losses. Baffles 66, 84 and 86 may be plates of metal designed to reflect the combustion noise back to the source or they may be composite plates consisting of a solid backing plate (flame cell side) covered on the fire tube side by an open cell material which in turn is covered by a perforated plate. This arrangement is illustrated in FIG. 6 in which a solid backing plate 106, which faces the flame cell side, is covered on the fire tube side by an open cell material 108 which, in turn, is covered by a perforated plate 110. More specifically, baffle 66 of FIG. 1 and baffles 66 and 86 and toroidal baffle 84 of FIG. 2 can be, and preferably are, constructed as illustrated in FIG. 6.

In order to broaden the bandwidth of noise attenuation, perforated tube 24 is preferably surrounded by a sound absorptive layer 93 as illustrated in FIGS. 3 and 4. This sound absorptive layer can be formed of material such as corrugated fabric, paper, foam, fiberglass or other material having characteristics to provide minimum pressure drop of the flow of air therethrough while broadening sound absorption.

In designing equipment to incorporate the principles of this invention, the preferred arrangement of the flame cell housing, the perforated cylinder, the baffle plates and sound absorbing materials can be selectably tuned to absorb sound energy across a broad bandwidth. In addition, the internal surface of the flame cell housing can be covered in a suitable sound absorptive material, such as element 56 as shown in FIGS. 1 through 4. Several materials are commercially available to function as sound absorptive material 56 that are selected to prevent sound waves striking the surface of the flame cell housing, either cylindrical flame cell housing 48 as in FIGS. 1 and 2 or the rectangular flame cell housing 90 in FIGS. 3 and 4.

The embodiments illustrated and described herein are for purposes of exemplification with the understanding that the scope of this disclosure is not limited to these illustrated and described embodiments. Actual structures that incorporate the invention may have appearances completely dissimilar from these illustrated herein.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed:

1. A gas burner system providing reduced noise levels comprising:

a mixer having attached thereto a gas delivery pipe, fuel gas and air being combined in the mixer to provide mixed gas and air;

a burner nozzle in communication with said mixer through which said mixed gas and air is passed;

a sound absorbing flame cell housing having an exterior and providing an interior surrounding said mixer, having an outlet opening through which said mixed pas and air is passed and an air inlet opening;

a perforated tube positioned within said flame cell housing and receiving said mixer and dimensioned to provide an annular area exterior of the perforated tube within said flame cell housing; and a flame arrestor closing said flame cell housing air inlet opening permitting air to pass into said flame cell housing and prohibiting the passage of flame therethrough, air flowing through said flame arrestor into said annular area and through said perforated tube to said mixer.

2. A gas burner system according to claim 1 including:

a sound absorbing flame arrestor cover spaced exteriorly of said flame cell and adjacent said flame arrestor and configured to permit free passage of air into said flame arrestor but prohibiting straight line path passage of sound through said flame arrestor from said interior to said exterior of said flame cell housing.

3. A gas burner system according to claim 1 wherein the system is configured to supply heat to the interior of an enclosure through an inlet opening therein and wherein said flame cell housing outlet opening is in communication with said inlet opening.

4. A gas burner according to claim 1 including a venturi having an inlet end and an outlet end, the inlet end being affixed to said mixer to receive the flow of gas from said mixer, and the outlet end being connected to said burner nozzle, the venturi serving to draw air into said mixer.

5. A gas burner system according to claim 3 wherein said enclosure is in the form of a fire tube having said inlet opening and wherein said flame cell housing outlet opening is in communication with fire tube inlet opening.

6. A gas burner system according to claim 5 wherein said burner nozzle extends within said fire tube.

7. A gas burner system according to claim 5 including at least one baffle affixed and extending generally radially of said burner nozzle.

8. A gas burner system according to claim 7 wherein said at least one baffle affixed to said burner nozzle is positioned within said flame cell housing outlet opening.

9. A gas burner system according to claim 7 including a baffle housing in communication with said flame cell housing outlet opening, the baffle housing providing an area of increased internal dimensions through which said burner nozzle extends, said baffle being positioned within said baffle housing and being dimensioned to provide a tortuous path for air flow from said interior of said flame cell housing through the baffle housing.

10. A gas burner for use on the inlet end of a fire tube, the burner providing reduced noise levels, comprising:

a mixer having attached thereto a gas delivery pipe, fuel gas and air being combined in the mixer to provide mixed gas and air;

a venturi having an inlet end and an outlet end, the inlet end being affixed to said mixer to receive the flow of gas and air from said mixer, the venturi serving to draw air into said mixer;

a burner nozzle having an inlet end affixed to said venturi outlet end and having an outlet end extending to within a fire tube inlet end;

a perforated tube having a first end and an open second end, said mixer and venturi being received with the perforated tube with said burner nozzle extending out the open second end, the second end of the perforated tube being in closed communication with the fire tube inlet end;

a sound absorbing flame cell housing at least substantially surrounding said perforated tube and having at least one air inlet opening therein; and a foraminous flame arrestor closing said flame cell housing air inlet opening and serving to permit air to pass into said flame cell housing and prohibiting the passage of flame therethrough.

11. A reduced noise level gas burner according to claim 10 comprising a blanket of air permeable sound absorbing material supported to said perforated tube.

12. A gas burner system providing reduced noise levels compromising:

a mixer having attached thereto a gas delivery pipe, fuel gas and air being combined in the mixer to provide mixed gas and air;

a burner nozzle in communication with said mixer through which said mixed gas and air is passed;

a sound absorbing flame cell housing having an exterior and providing an interior surrounding said mixer, having an outlet opening through which said mixed gas and air is passed and an air inlet opening;

a flame arrestor in communication with said flame cell housing air inlet opening permitting air to pass into said flame cell housing and prohibiting the passage of flame therethrough; and a sound deflecting generally radially extending baffle positioned in said flame cell housing outlet opening and having an opening therethrough receiving said burner nozzle.

13. A gas burner system according to claim 12 including:

a sound absorbing flame arrestor cover spaced exteriorly of said flame cell housing configured to permit passage of air into said air inlet opening but prohibiting straight line path passage of sound through said flame arrestor from said interior to said exterior of said flame cell housing.

14. A gas burner system according to claim 12 wherein the system is configured to supply heat to the interior of an enclosure thorough an inlet opening therein and wherein said flame cell housing outlet opening is in communication with said enclosure inlet opening.

15. A gas burner according to claim 12 including a venturi having an inlet end and an outlet end, the inlet end being affixed to said mixer to receive the flow of gas from said mixer, and the outlet end being connected to said burner nozzle, the venturi serving to draw air into said mixer.

16. A gas burner system according to claim 14 wherein said enclosure is in the form of a firetube having said inlet opening and wherein said flame cell housing outlet opening is in communication with firetube inlet opening.

17. A gas burner system according to claim 16 wherein said burner nozzle extends within said firetube.

18. A gas burner system according to claim 12 including a baffle housing in communication with said flame cell housing outlet opening, the baffle housing providing an area of increased internal dimensions through which said burner nozzle extends, said baffle being positioned within said baffle housing and being dimensioned to provide a tortuous path for air flow from said interior of said flame cell housing through the baffle housing.

19. A gas burner system according to claim 12 including:

a perforated tube positioned within said flame cell housing and receiving said mixer and dimensioned to provide an annular area exterior of the perforated tube within said flame cell housing, air flowing through said flame arrestor into said annular area and through the perforated tube to said mixer.

* * * * *

UNITED STATES PATENT AND TRADEMARK OFFICE

CERTIFICATE OF CORRECTION

PATENT NO : 6,106,276

DATED : August 22, 2000

INVENTOR(S): Gary W. Sams; Merle B. Inman, both of Tulsa, Okla.

It is certified that error appears in the above-identified patent and that said Letters Patent is hereby corrected as shown below:

Column 9, line 27, "pas" should be --gas--;
Column 10, line 39, "compromising" should be --comprising--; and
Column 10, line 67, "thorough" should be --through--.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*